US010648266B2

(12) United States Patent
Su et al.

(10) Patent No.: US 10,648,266 B2
(45) Date of Patent: May 12, 2020

(54) DOWNHOLE MILLING CUTTING STRUCTURES

(71) Applicant: Wellbore Integrity Solutions LLC, Houston, TX (US)

(72) Inventors: Zhenbi Su, Spring, TX (US); Vijayakumar Palani, The Woodlands, TX (US); Sudarsanam Chellappa, Houston, TX (US); Jianbing Hu, Houston, TX (US); Christopher Glass, Willis, TX (US); Timothy Andrew Burdett, Houston, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 15/719,672

(22) Filed: Sep. 29, 2017

(65) Prior Publication Data

US 2018/0094496 A1 Apr. 5, 2018

Related U.S. Application Data

(60) Provisional application No. 62/403,054, filed on Sep. 30, 2016.

(51) Int. Cl.

| | |
|---|---|
| ***E21B 29/06*** | (2006.01) |
| ***E21B 7/06*** | (2006.01) |
| ***E21B 10/26*** | (2006.01) |
| ***E21B 10/43*** | (2006.01) |
| ***E21B 29/00*** | (2006.01) |

(52) U.S. Cl.

CPC ..... *E21B 29/002* (2013.01); *E21B 7/061* (2013.01); *E21B 10/26* (2013.01); *E21B 29/06* (2013.01)

(58) Field of Classification Search

CPC ..... E21B 7/061; E21B 10/26; E21B 29/06; E21B 29/002; E21B 10/43; E21B 10/54; E21B 2010/566

See application file for complete search history.

(56) References Cited

U.S. PATENT DOCUMENTS

| | | | | |
|---|---|---|---|---|
| 5,769,166 | A | 6/1998 | Duke | |
| 5,887,655 | A * | 3/1999 | Haugen | E21B 7/061 166/298 |
| 6,170,576 | B1 * | 1/2001 | Brunnert | E21B 10/46 166/298 |
| 6,715,567 | B2 | 4/2004 | Delgado et al. | |
| 9,074,434 | B2 * | 7/2015 | Mensa-Wilmot | E21B 10/43 |
| 9,273,519 | B2 | 3/2016 | Smith | |
| 9,284,784 | B2 * | 3/2016 | Zaki | E21B 10/26 |
| 9,416,612 | B2 * | 8/2016 | Stowe | E21B 10/46 |
| 9,470,048 | B1 * | 10/2016 | Smith | E21B 7/28 |
| 10,000,973 | B2 * | 6/2018 | Shotwell | E21B 10/26 |

(Continued)

FOREIGN PATENT DOCUMENTS

WO 2016099486 A1 6/2016

*Primary Examiner* — Kenneth L Thompson

(74) *Attorney, Agent, or Firm* — Hubbard Johnston, PLLC

(57) ABSTRACT

Systems, tools, and methods include using a milling assembly with a mill having multiple, different types of cutting element inserts. A gage region of the mill includes a first type of cutting element insert, and a shoulder region of the mill includes a second type of cutting element insert. One cutting element insert may include chip-breaking features, and the other may be a shear or gouging cutting element.

18 Claims, 9 Drawing Sheets

(56) References Cited

U.S. PATENT DOCUMENTS

| | | | | |
|---|---|---|---|---|
| 2001/0035302 | A1* | 11/2001 | Desai | E21B 10/54<br>175/61 |
| 2001/0037609 | A1* | 11/2001 | Jensen | B22F 7/06<br>51/293 |
| 2008/0093076 | A1* | 4/2008 | Patil | E21B 7/064<br>166/298 |
| 2015/0259988 | A1* | 9/2015 | Chen | E21B 10/5673<br>175/430 |
| 2016/0265281 | A1* | 9/2016 | Beaton | E21B 29/00 |
| 2017/0138139 | A1 | 5/2017 | Hern et al. | |

* cited by examiner

DOWNHOLE MILLING CUTTING STRUCTURES

CROSS-REFERENCE TO RELATED APPLICATIONS

This application claims the benefit of, and priority to, U.S. Patent Application No. 62/403,054 filed on Sep. 30, 2016, which is incorporated herein by this reference in its entirety.

BACKGROUND

In the production of hydrocarbons, a wellbore may be drilled to target a zone of interest in which oil or gas is thought to be located. After the wellbore is drilled, casing may be installed in the wellbore. The casing may provide structural integrity to the wellbore and isolate the wellbore to prevent fluids in portions of the formation from flowing into the wellbore, and to prevent fluids from the wellbore from flowing out into the formation. Casing may be formed of strings of steel or other metallic tubulars that line the wellbore. Cement may be pumped into an annular region around the outer surface of the casing and allowed to cure to secure the casing in place.

Portions of casing may be removed in order to facilitate certain downhole operations such as sidetracking, hydraulic fracturing, slot recovery, and wellbore abandonment. For instance, in sidetracking, a whipstock may be anchored in the wellbore and a milling tool may be tripped into the wellbore. The milling tool may be guided by the whipstock into the casing. By rotating the milling tool and applying weight or another downhole force, the milling tool may cut and mill away a portion of the casing to form an opening or window. The milling tool or a drill bit may then be extended through the window in the casing in order to drill a deviated or other lateral borehole. In a slot recovery or wellbore abandonment operation, a section mill may be inserted into the wellbore. The section mill may include blades that expand outward and contact the casing. As the section mill is rotated and moved longitudinally within the wellbore, a full circumference of a section of casing may be removed from around the wellbore.

SUMMARY

Embodiments of the present disclosure may relate to tools and methods for using tools. An example tool, for instance, may include a drill string and a lead mill at a downhole end portion of the drill string. A second mill is coupled to the drill string and is either a dress mill or a follow mill. The second mill includes a gage region with a first type of cutting element insert, and a shoulder region with a second type of cutting element insert.

In one or more additional embodiments, a follow mill includes a body integrally formed with a tubular on each opposing end of the body. A plurality of blades extend axially along, and radially from, the body. The blades define gage and tapered shoulder regions. Chip-breaking inserts are in the gage region of the plurality of blades. A second type of cutting insert is in the tapered shoulder region, and is not within the gage region.

In other embodiments, a method for milling a window in casing includes tripping a downhole tool into a wellbore. The downhole tool including at least a lead mill and a dress mill or a follow mill. A window is formed in casing around the wellbore using the lead mill. The lead mill is moved through the window, and the window is expanded—or casing around the window is cleaned up, with the dress or follow mill. Expanding or cleaning-up the window includes using a shear cutting element insert in a shoulder region of the dress or follow mill, and using a chip-breaking cutting element insert in a gage region of the dress or follow mill.

This summary is provided to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings depict just some example embodiments and are not to be considered to be limiting in scope, nor drawn to scale for each embodiment contemplated hereby, various embodiments will be described and explained with additional specificity and detail through the use of the accompanying drawings in which:

FIG. 5-1 is a perspective view of dress mill of a milling system, in accordance with one or more embodiments of the present disclosure;

FIG. 5-2 is a cross-sectional view of the dress mill of FIG. 5-1, in accordance with one or more embodiments of the present disclosure;

DETAILED DESCRIPTION

In accordance with some aspects of the present disclosure, embodiments herein relate to milling tools. According to other aspects of the present disclosure, embodiments herein relate to downhole tools. More particularly, some embodiments disclosed herein may relate to downhole tools, milling systems, and bottomhole assemblies that include one or more mills. An example bottomhole assembly may include a mill for use in a sidetracking, junk milling, fishing, remedial, or other downhole operation. In still other aspects, embodiments of the present disclosure may relate to cutting structures for use on a mill such as a dress mill or follow mill.

Figure 1:
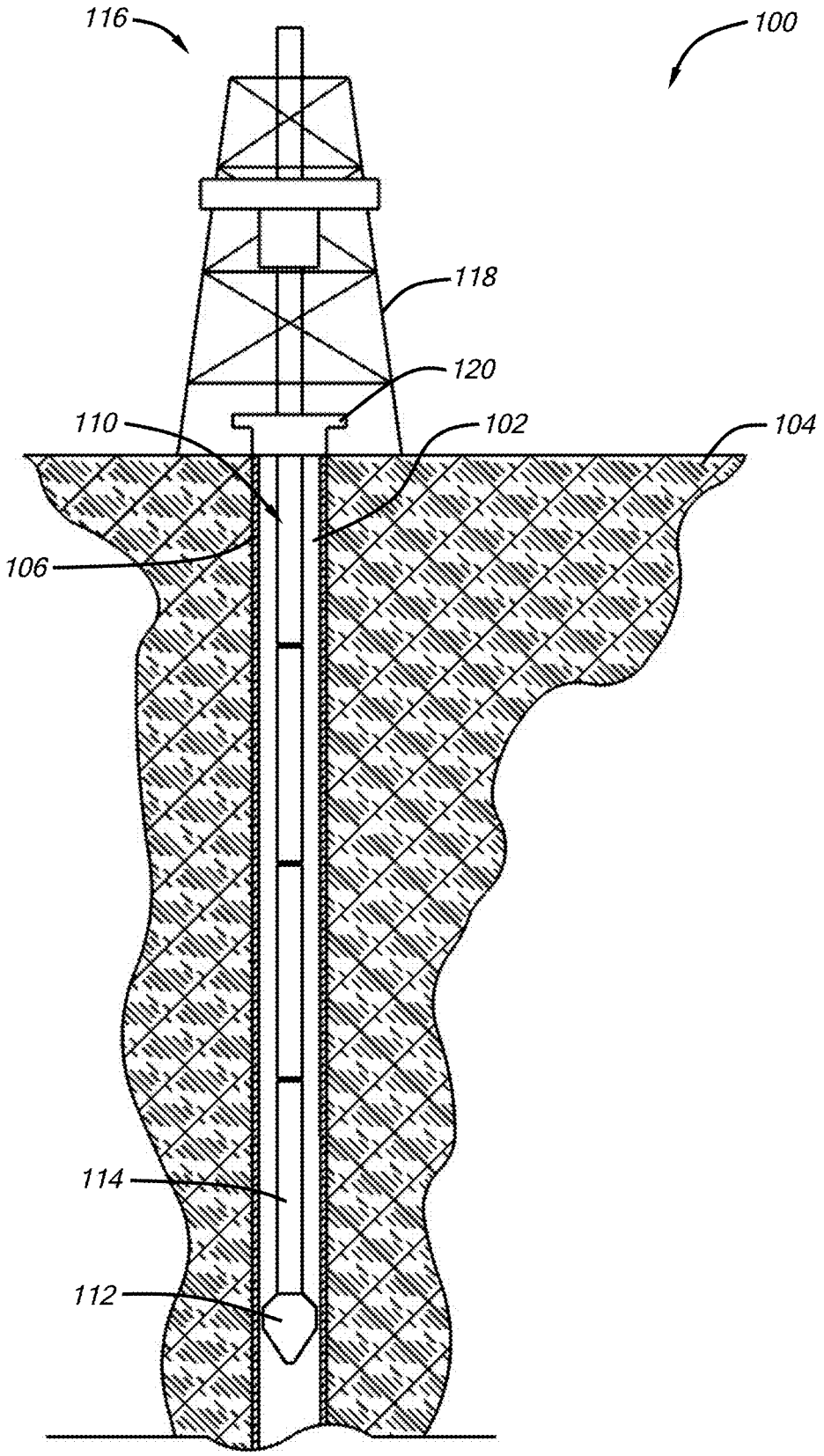
FIG. 1 is a schematic illustration of an example milling system, in accordance with one or more embodiments of the present disclosure.

Referring now to FIG. 1, a schematic diagram is provided of an example milling system 100 that may utilize milling systems, assemblies, devices, and methods in accordance with embodiments of the present disclosure. FIG. 1 shows an example wellbore 102 formed in a formation 104. In this particular embodiment, the wellbore 102 includes a casing 106 installed therein. The casing 106 may extend along a full length of the wellbore 102; however, in other embodiments, at least a portion of the wellbore 102 may be an openhole or uncased wellbore. The casing 106 within the wellbore 102 may include various types of casing, including surface casing, intermediate casing, conductor casing, production casing, production liner, and the like. In some embodiments, as the depth of the wellbore 102 increases, the diameter of the casing 106 may decrease.

In at least some embodiments, the casing 106 may provide structural integrity to the wellbore 102, isolate the wellbore 102 against fluids within the formation 104, or perform other aspects or functions. In some applications, after the casing 106 is cemented or otherwise installed within the wellbore 102, a portion of the casing 106 may be removed to facilitate a downhole operation. In FIG. 1, for instance, a downhole tool 110 may be inserted into the wellbore to remove a portion of the casing 106. The downhole tool 110 may include a mill 112 coupled to a drill string 114. When the downhole tool 110 includes one or more mills, the downhole tool 110 may also be considered a milling assembly. The drill string 114 may include sections of drill pipe, transition drill pipe, drill collars, coiled tubing, or other drive mechanisms or delivery devices that allow the mill 112 to be tripped into the wellbore 102 for an operation such as milling a portion of the casing 106, drilling formation, etc.

A whipstock (see FIG. 2) may be used to deflect the mill 112 into the casing 106 to form a window therein. In such an embodiment, the mill 112 may be, or include, a window mill, taper mill, lead mill, or the like. The mill 112 may also include additional components such as dress mills, follow mills, stabilizers, other components, or combinations of the foregoing. After formation of the window in the casing 106, the mill 112 may be used to drill a full or partial portion of a lateral borehole in the formation 104. In some embodiments, after formation of the window in the casing 106, the mill 112 may be removed and a drill string with a drill bit (not shown) may be tripped into the wellbore 102 and pass through the window to form or extend a lateral borehole.

The downhole tool 110 may also be used for additional or other downhole operations. The mill 112 may, for instance, be a mill and drill bit and may be used in the sidetracking operation, potentially without the use of a separate drill bit. The mill 112 may include a junk mill or other similar tool to cut, mill, and grind up tools, debris, or other items found within the wellbore 102 or a lateral borehole. For instance, a bridge plug (not shown) may be set within the wellbore 102, and the mill 112 may be used to grind up the bridge plug to open fluid flow between upper and lower zones within the wellbore 102. The mill 112 may also be another type of bit (e.g., a drill bit) and usable to perform drilling operations on the formation 104 rather than milling operations on the casing 106 or other components in the wellbore 102.

In the particular embodiment illustrated in FIG. 1, the downhole tool 110 may be provided to facilitate a milling operation. The mill 112 may be part of a bottomhole assembly coupled to the drill string 114. In FIG. 1, the drill string 114 is illustrated as extending from the surface and having the bottomhole assembly or mill 112 at the distal end portion thereof. The drill string 114 may include one or more tubular members. The tubular members of the drill string 114 may themselves have any number of configurations. As an example, the drill string 114 may include segmented/jointed drill pipe or wired drill pipe. Such drill pipe may include rotary shouldered or other threaded connections on opposing ends to allow segments of drill pipe to be coupled together to increase the length of the drill string 114 as the mill 112 is tripped further into the wellbore 102, or disconnected to shorten the length of the drill string 114 as the mill 112 is tripped out of the wellbore 102. The drill string 114 may also include continuous components such as coiled tubing. Couplings, drill collars, transition drill pipe, stabilizers, and other drill string and bottomhole assembly components known in the art, or combinations of the foregoing, may also be used.

To use the mill 112 for a downhole operation, uphole or downhole rotational power may be provided to rotate the mill 112. A drilling rig 116, for instance, may be used to convey the drill string 114 and mill 112 into the wellbore 102. In an example embodiment, the drilling rig 116 may include a derrick and hoisting system 118, a rotating system, a mud circulation system, or other components. The derrick and hoisting system 118 may suspend the downhole tool 110, and the drill string 114 may pass through a wellhead 120 and into the wellbore 102. In some embodiments, the drilling rig 116 or derrick and hoisting system 118 may include a draw works, a fast line, a crown block, drilling line, a traveling block and hook, a swivel, a deadline, other components, or some combination of the foregoing. An example rotating system may be used, for instance, to rotate the drill string 114 and thereby also rotate the mill 112 or other components of the downhole tool 110. The rotating system may include a top drive, kelly, rotary table, or other components that can rotate the drill string 114 at or above the surface. In such an embodiment, the drill string 114 may be a drive mechanism for use in driving, or rotating, the mill 112.

In other embodiments, the mill 112 may be rotated by using a downhole component. For instance, the downhole tool 110 may include a downhole motor as discussed herein. The downhole motor may operate as a drive mechanism and may include any motor that may be placed downhole, and expressly may include a mud motor, turbine motor, other motors or pumps, any component thereof, or any combination of the foregoing. A mud motor may include fluid-powered motors such as positive displacement motors ("PDM"), progressive cavity pumps, Moineau pumps, other type of motors, or some combinations of the foregoing. Such motors or pumps may include a helical or lobed rotor that is rotated by flowing drilling fluid. The drill string 114 may include coiled tubing, slim drill pipe, segmented drill pipe, or other structures that include an interior channel within a tubular structure. The interior channel or bore may allow drilling fluid to pass from the surface to the downhole motor. In the mud motor, the flowing drilling fluid may rotate the lobed rotor relative to a stator. The rotor may be coupled to a drive shaft, which can directly or indirectly be used to rotate the mill 112. In the same or other embodiments, the motor may include turbines. A turbine motor may be fluid-powered and may include one or more turbines or turbine stages that include a set of stator vanes that direct drilling fluid against a set of rotor blades. When the drilling fluid contacts the rotor blades, the rotor may rotate relative to the stator and a housing of the turbine motor. The rotor blades may be coupled to a drive shaft (e.g., through compression, mechanical fasteners, etc.), which may also rotate and cause the mill 112 to rotate.

Although the milling system 100 is shown in FIG. 1 as being on land, those of skill in the art will recognize that embodiments of the present disclosure are also equally applicable to offshore and marine environments. Additionally, while embodiments herein discuss milling operations within a cased wellbore, in other embodiments, aspects of the present disclosure may be used in a milling or drilling operation in an openhole wellbore, or an openhole section within a wellbore. Further still, milling or drilling systems may be used in accordance with some embodiments of the present disclosure above the surface rather than in a downhole environment.

Figure 2:
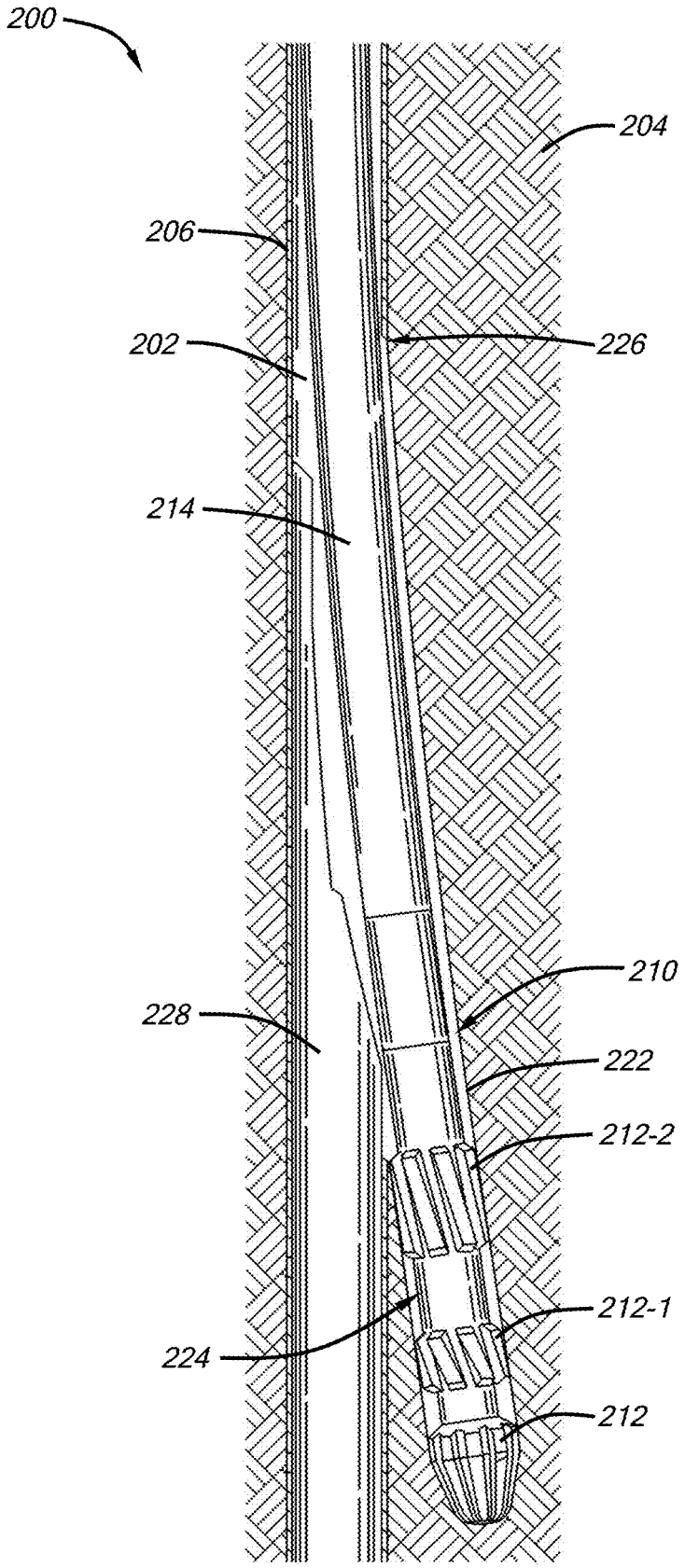
FIG. 2 is a partial cross-sectional view of a milling system during a sidetracking operation, in accordance with one or more embodiments of the present disclosure.

With reference now to FIG. 2, another example of a milling system 200 is shown in additional detail. In particular, the milling system 200 is shown as being configured for use in a sidetracking operation during which a downhole tool 210 may be tripped into a primary wellbore 202 and used to form a deviated or other lateral borehole 222 branching off from the primary wellbore 202.

More particularly, in the illustrated embodiment, the downhole tool 210 may include a bottomhole assembly 224 coupled to a drill string 214. The drill string 214 and bottomhole assembly 224 may be tripped into the primary wellbore 202, which may have casing 206 installed therein. The bottomhole assembly 224 may include one or more mills configured to mill away a portion of the casing 206 and form a window 226 through the casing 206, and to expose the wellbore 202 to the formation 204. Examples of mills that may be included on the bottomhole assembly 224 include a lead mill 212 (or window mill or taper mill), a follow mill 212-1, a dress mill 212-2, a watermelon mill, other mills, or any combination of the foregoing.

In the illustrated embodiment, the lead mill 212 may be located at the distal or downhole end of the bottomhole assembly 224. The lead mill 212 may be deflected into the casing 206 by a whipstock 228 or other deflection member within the wellbore 202. The lead mill 212 may initially mill into the casing 206 to initiate formation of the window 226, and may subsequently drill partially into the formation 204. The follow mill 212-1 and the dress mill 212-2 may then pass through the window 226. In some embodiments, the follow mill 212-1 and the dress mill 212-2 may enlarge the window 226, smooth edges of the casing 206 around the window 226, or perform other milling or drilling functions.

In operation, the downhole tool 210 may be part of a downhole milling system used to form the lateral borehole 222 extending from the primary wellbore 202. The lead mill 212, follow mill 212-1, dress mill 212-2, and the like may be rotated by rotating the drill string 214 from the surface, rotating a drive shaft using a downhole motor, or in any other suitable manner. When weight—which is sometimes referred to as weight-on-bit or weight-on-mill—is applied to the bottomhole assembly 224, the lead mill 212, follow mill 212-1, and dress mill 212-2 may be subjected to various loads and forces, including shock or impact loads, torsional loads, shear loads, vibrational (lateral, axial, etc.) loads and fatigue, and the like. In some embodiments, such loads may cause the lead mill 212, the follow mill 212-1, or the dress mill 212-2 to vibrate within the primary wellbore 202, the lateral borehole 222, or the window 226. Such forces and vibrations may cause the mills 212, 212-1, 212-2 to form a window 226 of an irregular or undesired shape, cutting elements on the mills 212, 212-1, 212-2 to be damaged or even broken off the downhole tool 210, or other damage or undesirable effects.

Figure 3:
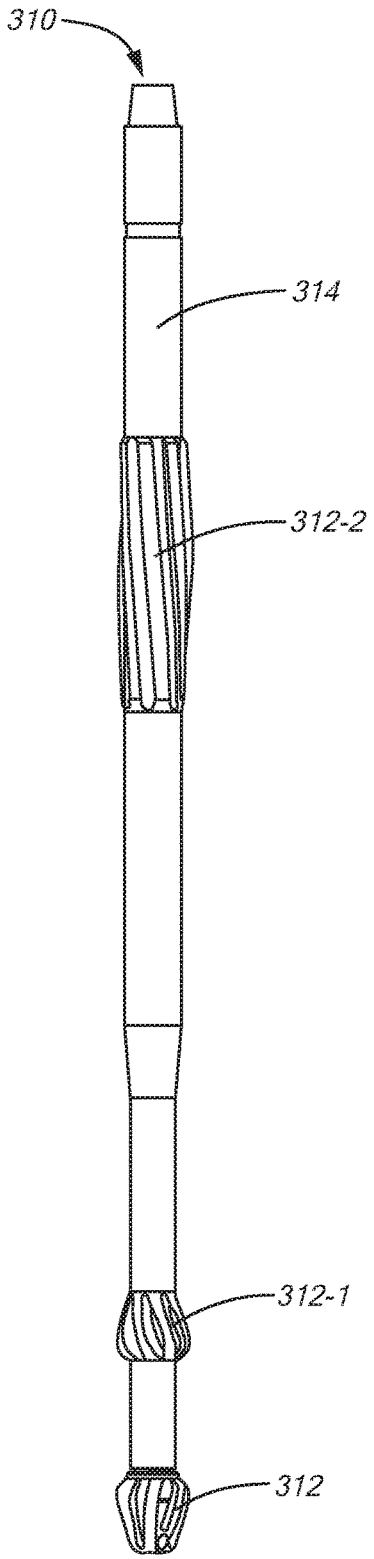
FIG. 3 is a side view of a downhole tool for performing a milling operation, in accordance with one or more embodiments of the present disclosure.

FIG. 3 illustrates an example milling tool 310 in accordance with some additional embodiments of the present disclosure. In the illustrated embodiment, the milling tool 310 includes a lead mill 312, a follow mill 312-1, and a dress mill (or watermelon mill) 312-2. The lead mill 312 may be located downhole of (or distal relative to) the follow mill 312-1 and the dress mill 312-2. The follow mill 312-1 may be located downhole and distal relative to the dress mill 312-2. A tubular components 314 may, in some embodiments, be used to couple the dress mill 312-2 to the follow mill 312-1 and the lead mill 312. The tubular components 314 may include drill collars, drill pipe, BHA components, other components or any combination of the foregoing.

One or more of the mills 312, 312-1, 312-2 may be coupled to each other or to tubular components 314 in any of a number of different manners. For instance, in some embodiments, any of the mills 312, 312-1, 312-2 may be welded to an adjacent tubular component 314. In other embodiments, any of the mills 312, 312-1, 312-2 may included internal threads, at one or more ends thereof, or along a full or partial length, and may be threadably coupled to an adjacent tubular component 314. In some embodiments, any of the mills 312, 312-1, 312-2 may be integrally formed with an adjacent tubular component 314. For instance, the dress mill 312-2 or the follow mill 312-1 may be machined from bar stock, forged, or otherwise formed to be integral and monolithic with a tubular element extending in one or more directions from the ends of the corresponding follow mill 312-1 or dress mill 312-2. Such a tubular element may then be welded, include threads, or otherwise be configured to be coupled to another tubular component 314 or other BHA or drill string component.

Figure 4:
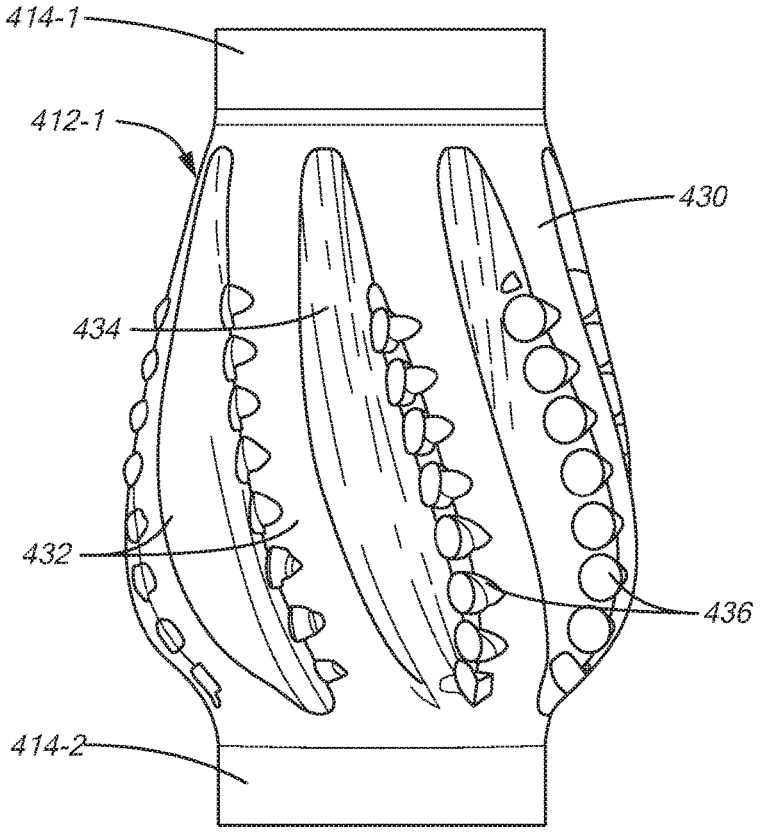
FIG. 4 is a perspective view of a follow mill of a milling system, in accordance with one or more embodiments of the present disclosure.

FIG. 4 illustrates an example follow mill 412-1 that may be used in connection with a downhole tool or milling tool (e.g., downhole or milling tools of FIGS. 1-3), in accordance with some embodiments of the present disclosure. In the embodiment shown in FIG. 4, a body 430 of the follow mill 412-1 is shown as being integrally formed with one or more tubular components. More particularly, an uphole end portion of the body 430 of the follow mill 412-1 is shown as being integral and monolithic with an uphole tubular component 414-1. A downhole end portion of the body 430 of the follow mill 412-1 is also shown as being integral and monolithic with a downhole tubular component 414-2. As used herein, components should be considered to be integral or monolithic when formed together. Thus, the body 430 and the tubular components 414-1, 414-2 would be considered integral or monolithic when collectively formed in a forging, casting, machining, or other similar process. In contrast, when components are formed separately and then joined (e.g., by welding, or by using threaded connections or mechanical fasteners), the components should be considered to be integral or monolithic.

In the embodiment shown in FIG. 4, the body 430 of the follow mill 412-1 is shown as including multiple blades 432 extending axially along, and radially from, the body 430. Junk slots, recesses, or other channels 434 may be located between adjacent blades 432, and may extend fully or partially along a length of the adjacent blades 432. The blades 432 may provide the cutting structure of the follow mill 412-1, and may be used to cut casing, formation, or other materials. The channels 434 may provide a fluid flow area in which fluid can flow to cool the cutting structure. In some embodiments, swarf or other cuttings generated by cutting the casing, formation, or other materials may flow through the channels 434. For instance, drilling fluid within the follow mill 412-1 may exit one or more nozzles in the follow mill 412-1, or through one or more other nozzles or ports in an attached downhole tool or component. The fluid may flow upward through the wellbore, and may carry cuttings/swarf through the channels 434 and toward the surface.

The follow mill 412-1 may have any number of different types of cutting structures, and the cutting structure may vary in accordance with the type of operation performed, the type of material being milled, the drilling fluid being used, and the like. In some embodiments, the blades 432 may themselves act as the cutting structure. In other embodiments, additional or other cutting structure may be used. For instance, as shown in FIG. 4, the blades 432 may have cutting elements 436 coupled thereto. According to at least some embodiments, the blades 432 may have pockets formed therein. The cutting elements 436 may have a shape corresponding to the shape of the pockets, and may be inserted and secured in the pockets. For instance, the cutting elements 436 may have a generally cylindrical base that may fit within a generally cylindrical pocket in the blades 436. Of course, in other embodiments, pockets in the blades 432 may have any other suitable shape (e.g., conical, frusto-conical, cubic, rectangular prism, hexagonal, octagonal, etc.)

The cutting elements 436 may be formed of any of a number of different materials, and may also have various shapes, sizes, and other configurations. In some embodiments, for instance, the cutting elements 436 may be formed from polycrystalline diamond, tungsten carbide, titanium carbide, cubic boron nitride, other superhard materials, or some combination of the foregoing. In at least some embodiments, the cutting elements 436 may have higher wear resistance properties than the materials of the body 430 (e.g., steel).

In addition to, or instead of, using cutting elements 432 within pockets in the blades 432, the blades 432 may have one or more other cutting elements coupled thereto. For instance, as discussed in more detail with respect to FIGS. 5-1 and 5-2, different portions of the blades 432 may have different types of cutting elements (e.g., a gauge portion of the blades 432 may have different types of cutting elements than tapered or other portions of the blades 432). In some embodiments, crushed carbide, hardfacing, or other similar materials may be applied to the blades 432. As used herein, cutting elements may generally be grouped into two categories—namely cutting applications and cutting inserts. Cutting applications are types of cutting elements that are not applied as discrete components, and which change shape when coupled to the body 430. For instance, crushed carbide and hardfacing may be applied to surfaces of the body 430 through a welding or similar process. The materials may be provided in a rod, and the application process may then change the material shape so that they are formed as a layer on portions of the body 430. In contrast, cutting inserts are cutting elements that are formed and coupled to the body 430 as discrete components, and which generally retain their shape. The cutting elements 436 shown in FIG. 4, for example, are types of cutting inserts as they are discrete components. The cylindrical cutting elements may remain cylindrical when brazed or otherwise coupled within the cutter pockets in the blades 432.

Figures 1, 5:
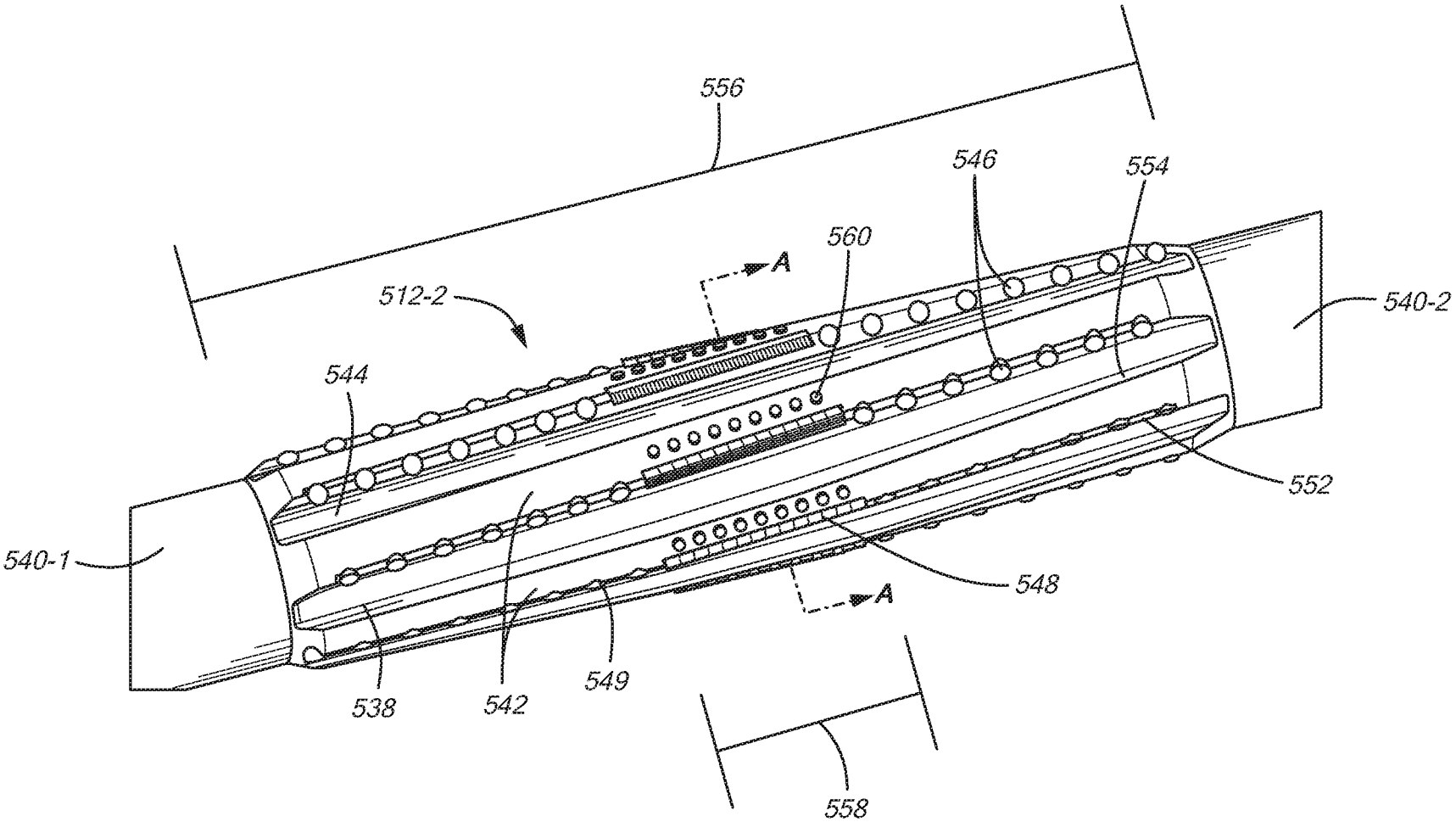
Figures 2, 5:
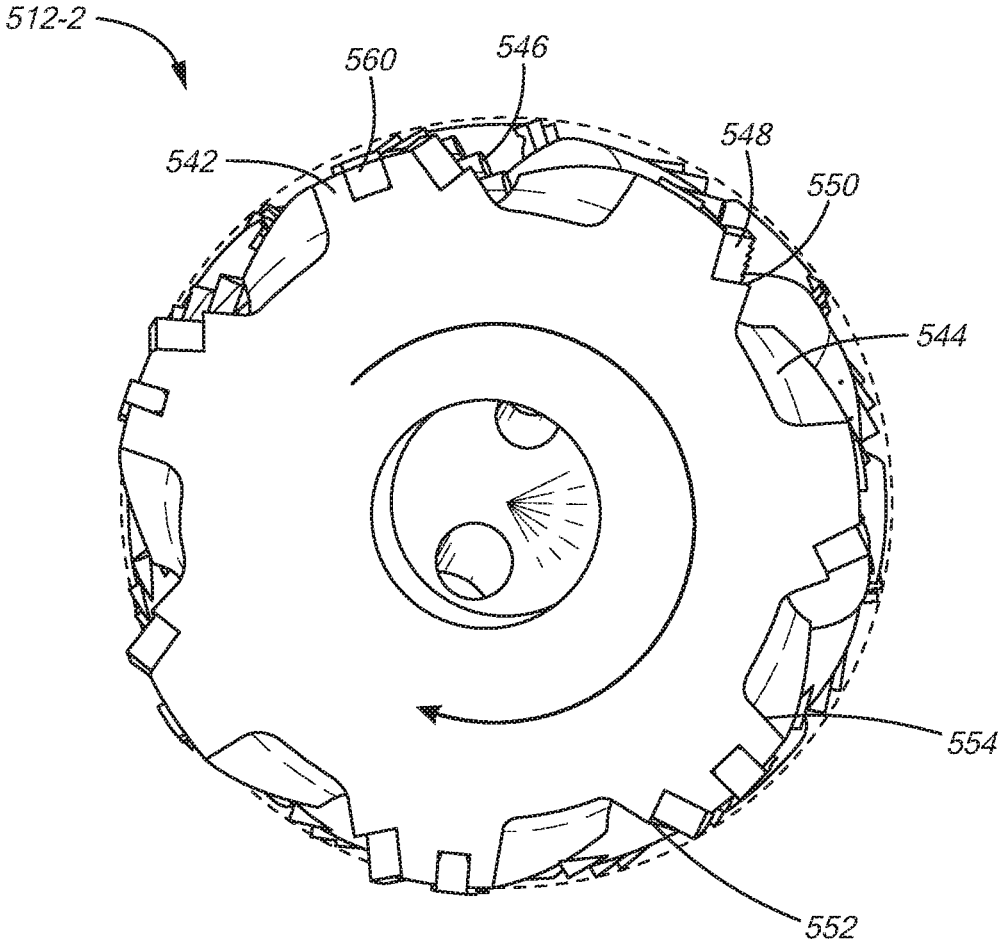

FIG. 5-1 is a perspective view of a dress mill 512-2 that may be used in connection with a downhole tool or milling tool (e.g., downhole or milling tools of FIGS. 1-3), according to some embodiments of the present disclosure. FIG. 5-2 is a cross-sectional view of the dress mill 512-2, taken along line A-A of FIG. 5-1. In the embodiment shown in FIGS. 5-1 and 5-2, a body 538 of the follow mill 512-2 is shown as being integrally formed with one or more tubular components. More particularly, an uphole end portion of the body 538 of the dress mill 512-2 is shown as being integral and monolithic with an uphole tubular component 540-1. A downhole end portion of the body 538 of the dress mill 512-2 is also shown as being integral and monolithic with a downhole tubular component 540-2.

In the embodiment shown in FIGS. 5-1 and 5-2, the body 538 of the dress mill 512-2 is shown as including multiple blades 542. Junk slots, recesses, or other channels 544 may be located between adjacent blades 542, and may extend fully or partially along a length of the adjacent blades 542. The blades 542 may provide the cutting structure of the dress mill 512-2, and may be used to cut casing, formation, or other materials. The channels 544 may provide a fluid flow area in which fluid can flow to cool the cutting structure, or in which fluid can carry cuttings/swarf longitudinally past the blades 542 (e.g., toward the surface).

The dress mill 512-2 may have any number of different types of cutting structures, and the cutting structure may vary in accordance with the type of operation performed, the type of material being milled, the drilling fluid being used, and the like. In some embodiments, the blades 542 may themselves act as the cutting structure. In other embodiments, additional or other cutting structure may be used. For instance, as shown in FIG. 5, the blades 542 may have multiple types of cutting elements 546, 548 coupled thereto. According to at least some embodiments, the blades 542 may have one or more pockets 549 formed therein. The cutting elements 546 may have a shape corresponding to the shape of a first type of pockets 549 in the blades 542, and may be inserted and secured in such pockets 549. For instance, the cutting elements 546 may have a generally cylindrical base that may fit within a corresponding, generally cylindrical pocket 549 in the blades 542. Of course, in other embodiments, pockets 549 in the blades 542 may have any other suitable shape (e.g., conical, frusto-conical, cubic, rectangular prism, hexagonal, octagonal, etc.)

The cutting elements 548 may also optionally be positioned in one or more pockets (e.g., a second type of pocket). In particular, as shown in FIG. 5-2, the portion of the blades 542 in which the cutting elements 548 are located, may include a recess 550. The cutting elements 548 may be located in the recess 550. In some embodiments, multiple cutting elements 548 may be located in the same recess 550 while each pocket 549 may include a single cutting element 546. In other embodiments, the recess 550 may have a single cutting element 548 therein, a pocket 549 may include multiple cutting elements 546 therein, or any combination of the forgoing.

In operation, the dress mill 512-2 may rotate (e.g., in the direction of the arrow shown in FIG. 5-2), and a leading edge 552 of each blade 542 may rotationally lead a trailing edge 554 of each blade 542. In some embodiments, the pockets 549 and recesses 550 may be formed on or adjacent the leading edges 552 of the blades 542. In this manner, as the dress mill 512-2 rotates, the cutting elements 546, 548 can engage and cut the formation, casing, or other workpiece. In some embodiments, recesses or other pockets may be formed at or adjacent the trailing edge 554. For instance, trailing cutting elements may be used in addition to, or sometimes instead of, cutting elements at the leading edge 552.

Each of the blades 542 may have the same length (e.g., length), although in some embodiments one or more blades 542 may have different lengths than one or more other blades 542. In at least some embodiments, the blades 542 may have a tapered profile or may otherwise define a variable diameter of the dress mill 512-2. In the illustrated embodiment, for instance, a gage portion 558 of the blades 542 defines a greatest radial position (or diameter) of the dress mill 512-2. The gage portion 558 is shown as being generally centered along the length 556 of the blades 542, although such configuration is illustrative only. In this particular embodiment, the blades 542 may taper radially inward as the distance from the gage portion 558 increases, such that the portions of the blades 542 adjacent the tubular components 540-1, 540-2 have the lowest diameter or radial position. Such a taper may follow a linear, parabolic, stepped, or other profile. In other embodiments, however, the blades 542 may have an undulating or other blade shape.

The length of the gage portion 558 may be varied in any number of manners. For instance, in some embodiments, the gage portion 558 may have a length that is between 5% and 75% of the length 556 of the blades 542. More particularly, in some embodiments, the length of the gage portion 558 may be within a range having lower, upper, or both lower and upper limits including any of 5%, 10%, 15%, 20%, 25%, 35%, 45%, 50%, 60%, or 75% of the length 556. For instance, the gage portion 558 may be greater than 5% or less than 75% of the length 556. In other embodiments, the gage portion 558 may be between 15% and 50%, or between 20% and 35% of the length 556. In still other embodiments, the gage portion 558 may be less than 5% or greater than 75% of the length 556.

In the embodiment shown in FIGS. 5-1 and 5-2, the cutting elements 546 and 548 are shown as being located in different portions of the blades 542. In particular, the cutting elements 548 (and recesses 550) may be located in the gage portion 558 of the blades 542, while the cutting elements 546 (and pockets 529) may be located outside the gage portion 558. The portions of the blades 542 outside the gage portion 558 may be referred to as tapered or shoulder portions of the blades 542. Although there may be some overlap in the areas of the blades 542 in which the different cutting elements 546 and 548 are located, in other embodiments, the different types of cutting elements 546 and 548 may be isolated to different portions of the blades 542 (e.g., shoulder vs. gage portions 558). Thus, when shoulder portions of the blades 542 are milling or otherwise cutting a workpiece, the cutting elements 546 may be engaged and performing the cutting. When the gage portions 558 of the blades 542 are milling or otherwise cutting a workpiece, the cutting elements 558 may be engaged and performing the cutting. As will be appreciated in view of the disclosure herein, the cutting elements 546 and 558 may be engaged at the same time, such as when a window or borehole has a tapered profile, such that both the shoulder portions and the gage portions 558 of the blades 542 are engaged and active in milling or other cutting.

As also shown in FIGS. 5-1 and 5-2, the blades 542 may include one or more other elements 560, in addition to cutting elements 546 or cutting elements 548. For instance, the gage portion 558 of the blades 542 are shown as having elements 560 that rotationally trail the cutting elements 548. Although merely illustrative, the elements 560 may be positioned between the leading and trailing edges 552, 554 on a radially outward facing surface. The elements 560 may be application-type elements, or insert-type elements, as discussed herein with respect to cutting elements.

In some embodiments, the elements 560 may be cutting elements configured to mill or otherwise cut a workpiece. In other embodiments, however, the elements 560 may be gage protection elements, depth-of-cut limiters, vibration suppression elements, or the like. For instance, a gage protection element may be placed within a pocket and set into the radially outward facing surface of the blade 542 (e.g., the gage portion 558 of the blade 542), and may be even with, slightly below, or slightly above the blade surface. The elements 560 (e.g., gage protection elements) may be arranged, designed, or otherwise configured to restrict or even prevent wear of the body 538, including the blades 542. For instance, as the dress mill 512-2 is used to mill, cut, or otherwise degrade formation, casing, or another workpiece in a wellbore, the workpiece may contact the gauge protection elements 560, which may limit contact with the material forming the blade 542. This can reduce the wear of the blade 542 and maintain the gage of the blade 542.

A depth-of-cut limiter may be used to restrict the depth that the cutting elements 548 or cutting elements 546 may cut into the formation, casing, or other workpiece. This may be used, for instance, to limit the amount of torque on the downhole tool, improve the life of the cutting elements 546, 548, or for other reasons. Similarly, a vibration suppression element may be used to limit the lateral, axial, or torsional vibrations experienced by the dress mill 512-2. Suppressing the vibration may limit impact or other damage to the cutting elements 546, 548 and the blades 542, or to other components of the downhole tool.

The cutting, gage protection, or other elements 546, 548, 560 may be formed from polycrystalline diamond, tungsten carbide, titanium carbide, cubic boron nitride, other superhard materials, or some combination of the foregoing. In some embodiments, the elements 546, 548, 560 have higher wear resistance properties than the materials of the body 538, the blades 542, or both (e.g., steel), and thus limit the amount of wear of the body 538 and/or the blades 542. In some embodiments, the elements 546, 548, 560 may include diamond enhanced inserts, diamond impregnated inserts, tungsten carbide inserts, semi-round top inserts, inserts with cutting capacity, other inserts or elements, or combinations of the foregoing.

Figure 6:
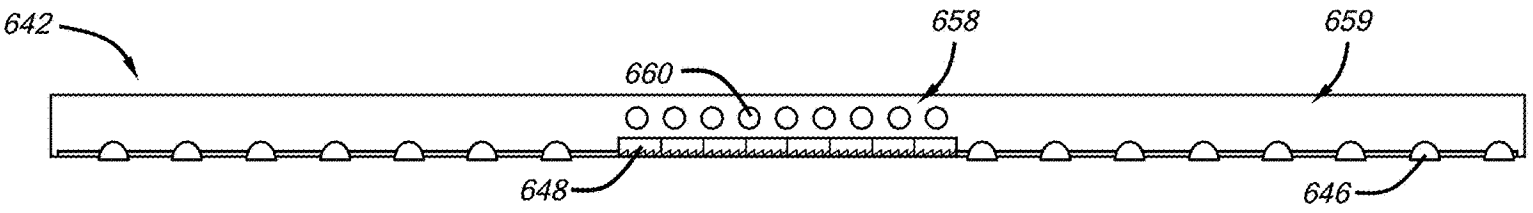
FIGS. 6 to 9 are schematic illustrates of example blades of a dress mill, in accordance with one or more embodiments of the present disclosure.

Turning now to FIGS. 6-9, various configurations of blades for use with a milling tool are illustrated, in accordance with some embodiments of the present disclosure. FIG. 6, for instance, illustrates a blade 642 that may be used in connection with certain milling tools, including at least dress mills and follow mills within a downhole tool. In this embodiment, the blade 642 includes a gage region 658 and a shoulder region 659 (which may be a tapered region in some embodiments). In this embodiment, the gage region 658 may be generally centered between two shoulder regions 659. The two shoulder regions 659 may have generally the same length and configuration, although in other embodiments they may be different. For instance, where the shoulder regions 659 are part of a follow mill such as the follow mill 412-1 of FIG. 4, a downhole shoulder region may be a different length than an uphole shoulder region.

In FIG. 6, the shoulder regions 659 may include a first type of cutting element 646, while the gage region 658 may include a second type of cutting element 648. In the illustrated embodiment, the first type of cutting element 646 may be, for instance, a shear cutting element insert having a planar front face surrounded by a cutting edge that shears the workpiece engaged by the corresponding milling tool. The first type of cutting element 646 may have a cylindrical or other body that is positioned in a pocket formed at or near the leading edge of the blade 642.

The second type of cutting element 648 may be located in the gage region 658, and may be a grinding cutting element insert having a contoured front face. The contoured front face may include one or more ridges or other surface features. For instance, the surface features may be designed to act as a chip-breaker to limit the length of swarf when milling casing or other materials in a wellbore. By breaking chips into smaller pieces, so-called birdnesting can be reduced and swarf can be more easily transported within the wellbore. The second type of cutting elements 648 may be positioned in a recess or other pocket. In this particular embodiment, for instance, a single recess/pocket may be formed along a length of the gage region 658, and multiple cutting elements 648 may be positioned in the same pocket/recess. In other embodiments, a single, elongated cutting element 648 may be positioned in the recess in the gage region 658.

Optionally, one or more gage protection or other elements/inserts 660 may be located in pockets or otherwise positioned on the blade 642. For instance, the gage protection elements 660 may be positioned in the gage region 658 at a position that rotationally trails the second type of cutting elements 648. In the same or other embodiments, the gage protection elements 660 may be positioned in the shoulder region 659 (e.g., rotationally trailing the first type of cutting elements 646).

Figure 7:
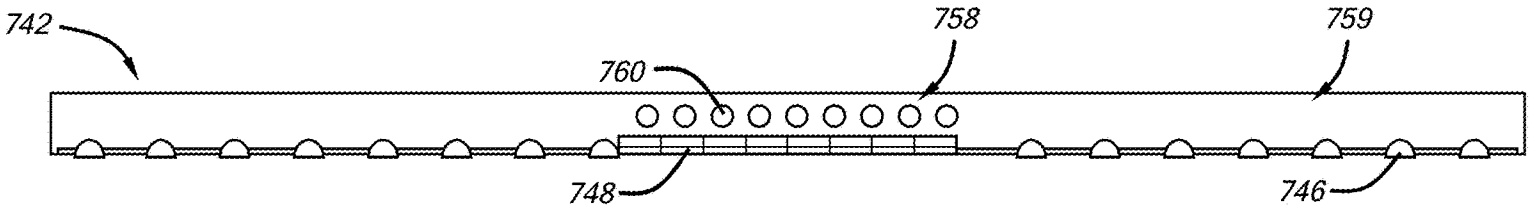

FIG. 7 illustrates another example of a blade 742 that may be used in connection with certain milling tools, including at least dress mills and follow mills within a downhole tool. In this embodiment, the blade 742 includes a gage region 758 and a shoulder region 759 (which may be a tapered region in some embodiments). In this embodiment, the gage region 758 may be generally centered between two shoulder regions 759. The two shoulder regions 759 may have generally the same length and configuration, although in other embodiments they may be different (e.g., with the follow mill 412-1 of FIG. 4).

In FIG. 7, the shoulder regions 759 may include a first type of cutting element 746, while the gage region 758 may include a second type of cutting element 748. As described with respect to the blade 642 of FIG. 6, the first type of cutting element 746 in the shoulder region 759 may be, for instance, a shear cutting element insert positioned in a pocket formed at or near the leading edge of the blade 742. The second type of cutting element 748 may be located in the gage region 758, and may be a grinding cutting element insert having a contoured front face, and may be positioned with one or more other cutting elements 748 in a recess or other pocket. The first type of cutting element 746 may be used for one type of cutting/milling (e.g., shear), while the second type of cutting element 748 may be used for a different type of cutting/milling (e.g., grinding, or chip-breaking). Optionally, one or more gage protection or other elements/inserts 760 may be located in pockets or otherwise positioned on the blade 742. For instance, the gage protection elements 760 may trail the second type of cutting elements 748, although they may also, or instead, be used in the shoulder region 759.

The blade 742 of FIG. 7 is similar to the blade 642 of FIG. 6, except that the position and orientation of some of the cutting and gage protection elements are different. For instance, the second type of cutting elements 748 may be the same as the second type of cutting elements 648, and may include cutting features such as the ridges shown in FIG. 6. In FIG. 7, however, the second type of cutting elements 748 may be rotated relative to the cutting elements 648 (e.g., rotated 90°). Thus, while the ridges in the cutting elements 648 may extend in a direction generally corresponding to a height of the blade, the ridges in the cutting elements 748 may extend in a direction generally corresponding to a length of the blade.

The first type of cutting elements 746 of the blade 742 of FIG. 7 are also shown as being offset, at different axial positions along the length of the blade 742, as compared to the first type of cutting elements 646 of the blade 642 of FIG. 6. The relative positions of the first types of cutting elements 646, 746 are merely illustrative. In some embodiments, each blade of a milling tool may have identical blades, with first types of cutting elements 646, 746 at the same axial positions. In other embodiments, however, the first types of cutting elements may be staggered. Thus, blades 642, 742 may be used on the same milling tool, and thus can stagger the positions of the first types of cutting elements 646, 746. Staggering the positions of the first types of cutting elements 646, 746 can include staggering the axial position, although adjusting the axial position may also adjust a radial position in embodiments where the first types of cutting elements 646, 746 are on tapered regions of a blade.

Similarly, the second types of cutting elements 648, 748 may also be axially and/or radially staggered on the different blades. In other embodiments, however, the second types of cutting elements 648, 748 on different blades of the same milling tool may not be staggered axially, but may instead have different orientations. In this manner, the second type of cutting elements may be the same, but may provide different cutting actions—including chip-breaking.

Optionally, the blade 742 of FIG. 7 may include gage protection or other elements 760. Such elements 760 may be provided in the gage region 758, the shoulder region 759, or in both the gage and shoulder regions 758, 759. Where multiple blades have gage protection or other elements 760, the different blades may have gage protection elements 760 at the same axial position or, as shown in comparing FIGS. 6 and 7, the gage protection elements 660, 760 on the same tool may have different axial, radial, or other positions.

Figure 8:
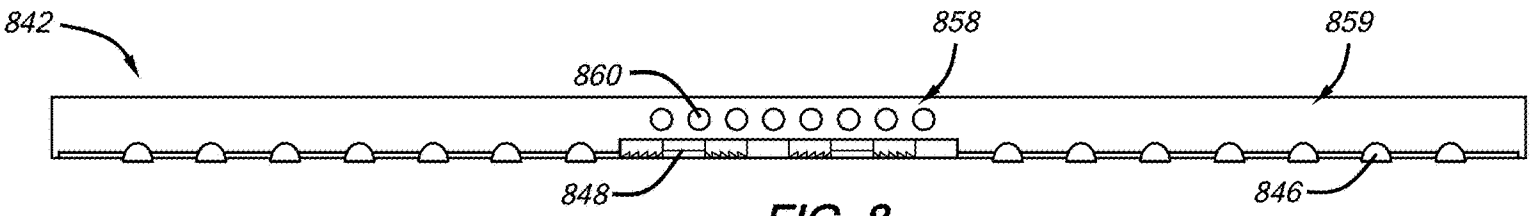

FIG. 8 illustrates another example of a blade 842 that may be used in connection with certain milling tools, including at least dress mills and follow mills within a downhole tool. In this embodiment, the blade 842 includes a gage region 858 and a shoulder region 859 (which may be a tapered region in some embodiments). In this embodiment, the gage region 858 may be generally centered between two shoulder regions 859. The two shoulder regions 859 may have generally the same length and configuration, although in other embodiments they may be different (e.g., with the follow mill 412-1 of FIG. 4).

In FIG. 8, the shoulder regions 859 may include a first type of cutting element 846, while the gage region 858 may include a second type of cutting element 848. As described with respect to the blades 642, 742 of FIGS. 6 and 7, the first type of cutting element 846 in the shoulder region 859 may be, for instance, a shear cutting element insert positioned in a pocket formed at or near the leading edge of the blade 842. The second type of cutting element 848 may be located in the gage region 858, and may be a grinding cutting element insert having a contoured front face, and may be positioned with one or more other cutting elements 848 in a recess or other pocket. The first type of cutting element 846 may be used for one type of cutting/milling (e.g., shear), while the second type of cutting element 848 may be used for a different type of cutting/milling (e.g., grinding, or chip-breaking). Optionally, one or more gage protection or other elements/inserts 860 may be located in pockets or otherwise positioned on the blade 842. For instance, the gage protection elements 860 may trail the second type of cutting elements 848, although they may also, or instead, be used in the shoulder region 859.

The blade 842 of FIG. 8 is similar to the blades 642, 742 of FIGS. 6 and 7, except that the position and orientation of some of the cutting and gage protection elements are different. For instance, the second type of cutting elements 848 may be the same as the second type of cutting elements 648, 748, and may include cutting features such as the ridges shown in FIG. 6. In FIG. 8, however, some of the second type of cutting elements 848 may be rotated relative to the cutting elements 648. For instance, every other second type of cutting element 848 is shown as being rotated about 90° relative to the adjacent cutting element 848. Thus, four different orientations of the cutting elements 848 are shown in the blade 842. Thus, some of the cutting elements 848 (e.g., every other) may have ridges or other features extending in a direction generally corresponding to a height of the blade 742, while other cutting elements 848 (e.g., every other) may have ridges or other features extending in a direction generally corresponding to a length of the blade 842.

The first type of cutting elements 846 of the blade 842 of FIG. 8 are also shown as being offset, at different axial positions (and potentially radial positions) along the length of the blade 842, as compared to the first types of cutting elements 646, 746 of the blades 642, 742 of FIGS. 6, and 7. As discussed herein, in some embodiments, different blades on the same milling tool may have different configurations of first and/or second types of cutting elements. Thus, the blade 842 could be used on a milling tool with either or both of the blades 642, 742 of FIGS. 6 and 7. In the same or other embodiments, the blade 842 may be used with other blades identical to the blade 842. For instance, a milling tool with six blades may have two blades 642, two blades 742, and two blades 842. In other embodiments, the milling tool may have three blades 642 and three blades 742, three blades 742 and three blades 842, or three blades 642 and three blades 842. In other embodiments, unequal numbers of blades may be used. For instance, in FIG. 5-2, the dress mill 512-2 has seven blades. Each of the seven blades may be different, or some may be the same.

Similarly, the second types of cutting elements 648, 848 may also be axially and/or radially staggered on the different blades. In other embodiments, however, the second types of cutting elements 648, 848 on different blades of the same milling tool may not be staggered axially, but may instead have different orientations. In this manner, the second type of cutting elements may be the same, but may provide different cutting actions—including chip-breaking by having a different orientation pattern (e.g., alternating pattern shown in FIG. 8 vs. constant orientations shown in FIGS. 6 and 7). Optionally, the blade 842 of FIG. 8 may include gage protection or other elements 860. Such elements 860 may be provided in the gage region 858, the shoulder region 859, or in both the gage and shoulder regions 858, 859. Where multiple blades have gage protection or other elements 860, the different blades may have gage protection elements 860 at the same axial position or, as shown in comparing FIGS. 6 and 8, the gage protection elements 660, 860 on the same tool may have different axial, radial, or other positions.

Figure 9:
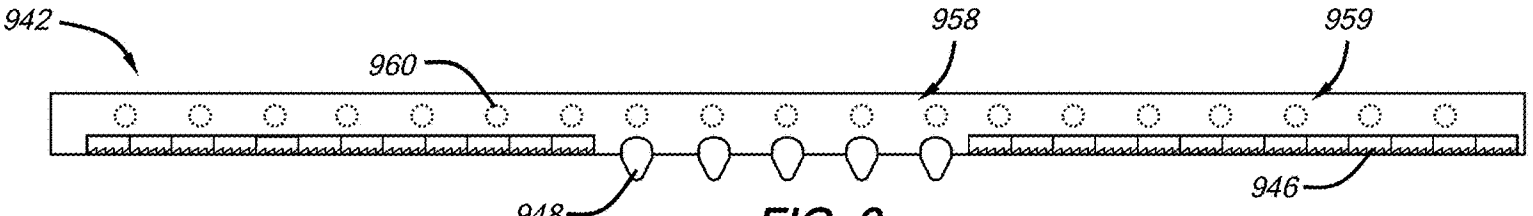

FIG. 9 illustrates another example of a blade 942 that may be used in connection with certain milling tools, including at least dress mills and follow mills within a downhole tool. In this embodiment, the blade 942 includes a gage region 958 and a shoulder region 959 (which may be a tapered region in some embodiments). In this embodiment, the gage region 958 may be generally centered between two shoulder regions 959. The two shoulder regions 959 may have generally the same length and configuration, although in other embodiments they may be different (e.g., with the follow mill 412-1 of FIG. 4).

In FIG. 9, the shoulder regions 959 may include a first type of cutting element 946, while the gage region 958 may include a second type of cutting element 948. In this particular embodiment, the first type of cutting element 946 in the shoulder region 959 may be, for instance, a grinding cutting element insert having a contoured front face, and positioned with one or more other similar cutting elements in a recess formed at or near the leading edge of the blade 942. The second type of cutting element 948 may be located in the gage region 958, and may be a shear cutting element insert having a planar cutting face, although in FIG. 9 the second type of cutting element 948 is shown as having a non-planar front face that may gouge or point load a workpiece. In contrast, shear cutting element having a planar face may use a cutting edge to have a shearing-type cutting action. The second type of cutting elements 948 may each be positioned in a pocket along the length of the gage region 958. The first type of cutting element 946 may be used for one type of cutting/milling (e.g., grinding or chip-breaking), while the second type of cutting element 948 may be used for a different type of cutting/milling (e.g., gouging or point loading). Optionally, one or more gage protection or other elements/inserts 960 may be located in pockets or otherwise positioned on the blade 942. For instance, gage protection elements 960 may trail the second type of cutting elements 948, although they may also, or instead, be used in the shoulder region 959.

The blade 942 of FIG. 9 is similar to the blades 642, 742 of FIGS. 6 and 7, except that the position and orientation of some of the cutting and gage protection elements are different. For instance, the first type of cutting elements 948 may be the grinding-type elements within a common recess, rather than with each in a single pocket (although a single pocket/recess may house a single first type of cutting element 948 in some embodiments). The gage region 958 then includes a different type of cutting element that doesn't shear or grind, but instead gouges or point-loads the workpiece. The blade 942 may be used on a milling tool including one or more of the blades of FIGS. 6-8, or the blade 942 may be used on a different milling tool.

While the first type of cutting elements 946 are all shown as having the same orientation, with ridges or other features of the first type of cutting elements 946 oriented to extend a direction generally corresponding to a height of the blade 942, this orientation is illustrative only. In other embodiments, each of the cutting elements 946 may be in a different orientation, or the orientation may change. For instance, there may be an alternating pattern (e.g., each cutting element 946 is rotated 90° relative to one or both adjacent cutting elements; orientation changes every two, three, four or more cutting elements 946; one shoulder region 959 has cutting elements 946 with a different orientation than cutting elements 946 in the other shoulder region 959, etc.), different blades may have different orientations of cutting elements 946, different blades may have the same orientations of cutting elements 946, or the orientations may be modified in other manners. Indeed, in some embodiments, the blades 642, 742, 842, 942 may use different types of grinding or other cutting element inserts (e.g., cutting inserts with different chip-breaking or other features).

Turning now to FIGS. 10-13, various example embodiments of cutting and chip-breaking cutting elements are shown. In some embodiments, cutting edges are formed to cut into a workpiece as a milling tool rotates, and one or more other features may be used to break a chip formed by the cutting edge. In at least some embodiments, the cutting elements of FIGS. 10-13 may be used as the second type of cutting elements 648, 748, 848 of FIGS. 6-8 or as the first type of cutting elements 946 of FIG. 9.

Figure 10:
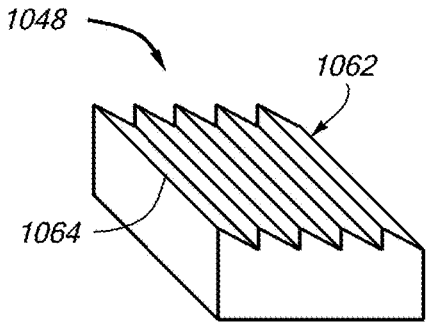
FIGS. 10 to 13 are perspective views of example milling cutting elements, in accordance with one or more embodiments of the present disclosure.

FIG. 10 illustrates a cutting element 1048 having a generally rectangular or square plan footprint. The front face 1062 of the cutting element 1048 may have multiple ridges therein. In some embodiments, a leading cutting edge 1064 may cut into a workpiece and form a chip. As the chip moves across the front face 1062, the chip may engage a trailing ridge, which may work harden the chip. A work hardened chip may be more brittle, and the chip may then tend to break. In some embodiments, the cutting element 1048 may have a square plan shape, or another shape allowing the cutting element 1048 to be placed in any of multiple orientations in a recess or pocket in a milling tool.

Figure 11:
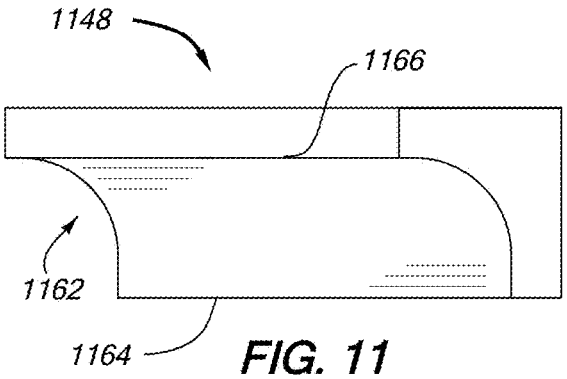

FIG. 11 illustrates a cutting element 1148 having a generally rectangular or square plan footprint. The front face 1162 of the cutting element 1148 may have a curved groove therein, and extending along a full length of the cutting element 1148. In some embodiments, a leading cutting edge 1164 may cut into a workpiece and form a chip. As the chip moves across the front face 1162, the chip may engage a trailing shoulder 1166, which may work harden or otherwise break the chip. In some embodiments, the cutting element 1148 may have a square plan shape, or another shape allowing the cutting element 1148 to be placed in any of multiple orientations in a recess or pocket in a milling tool.

Figure 12:
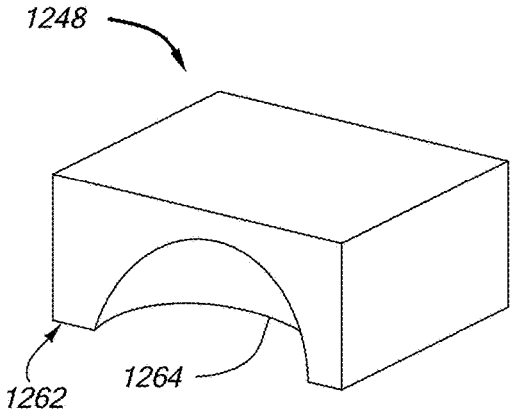

FIG. 12 illustrates a cutting element 1248 having a generally rectangular or square plan footprint. The front face 1262 of the cutting element 1248 may have a curved groove therein, and extending along a partial length of the cutting element 1248. In this particular embodiment, the groove may be a partial sphere or ellipsoid. In some embodiments, a leading cutting edge 1264 may cut into a workpiece and form a chip. As the chip moves across the front face 1262, the chip may follow along the groove, and an upper portion of the groove may work harden or otherwise break the chip. In some embodiments, the cutting element 1248 may have a square plan shape, or another shape allowing the cutting element 1248 to be placed in any of multiple orientations in a recess or pocket in a milling tool.

Figure 13:
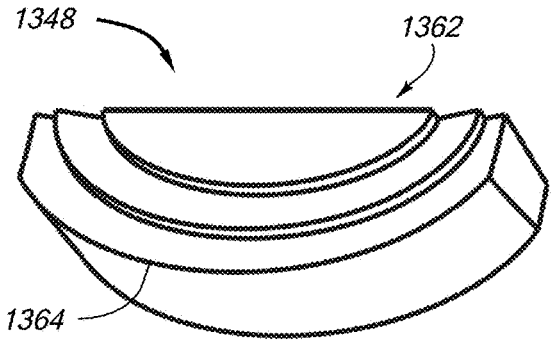

FIG. 13 illustrates a cutting element 1348 having a non-rectangular plan footprint. The front face 1362 of the cutting element 1348 may have multiple ridges therein. In some embodiments, a leading cutting edge 1364 is curved, may cut into a workpiece, and may form a chip. As the chip moves across the front face 1362, the chip may engage a trailing curved ridge, which may work harden and break the chip. In some embodiments, the cutting element 1348 may have a shape allowing the cutting element 1348 to be placed in any of multiple orientations in a recess or pocket in a milling tool.

In addition to chip-breaking cutting elements, other cutting elements (e.g., shear, gouging, point loading, line loading, etc.) may be used in some embodiments. Cutting elements may have a variety of configurations, and in some embodiments may have a planar cutting face (e.g., similar to cutting elements 436, 546 of FIGS. 4 and 5-1). "Non-planar cutting elements" will refer to those cutting elements having a non-planar cutting surface or end, such as a generally pointed cutting end ("pointed cutting element") or a generally conical cutting element having a crest or ridge cutting region ("ridge cutting element"), e.g., having a cutting end terminating in an apex, which may include cutting elements having a conical cutting end (shown in FIG. 14), a bullet cutting element (shown in FIG. 15), or a generally conical cutting element having a ridge (e.g., a crest or apex) extending across a full or partial diameter of the cutting element (shown in FIG. 17-1), for example.

Figure 14:
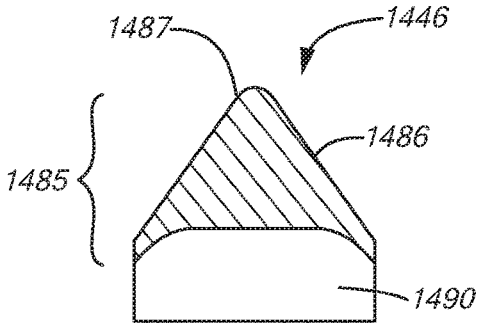
FIGS. 14 to 18 are cross-sectional and side perspective views of example cutting elements, in accordance with one or more embodiments of the present disclosure.
Figure 15:
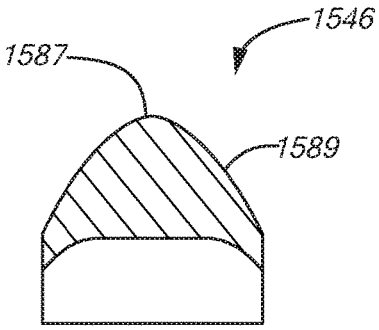
Figure 16:
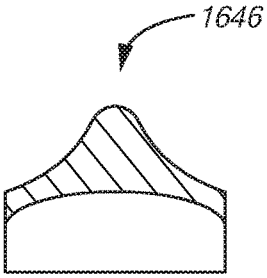

As used herein, the term "conical cutting elements" refers to cutting elements having a generally conical cutting end 1485 (including either right cones or oblique cones), i.e., a conical side wall 1486 that terminates in a rounded apex 1487, as shown in the cutting element 1446 of FIG. 14. Unlike geometric cones that terminate at a sharp point apex, the conical cutting elements of some embodiments of the present disclosure possess an apex 1487 having curvature between the side surfaces and the apex. Further, in one or more embodiments, a bullet cutting element 1546 may be used. The term "bullet cutting element" refers to a cutting element having, instead of a generally conical side surface, a generally convex side surface 1589 terminating at a rounded apex 1587. In one or more embodiments, the apex 1587 has a substantially smaller radius of curvature than the convex side surface 1589. Both conical cutting elements and bullet cutting elements are "pointed cutting elements," having a pointed end that may be rounded. It is also intended that the non-planar cutting elements of the present disclosure may also include other shapes, including, for example, a pointed cutting element may have a concave side surface terminating in a rounded apex, as shown by the cutting element 1646 of FIG. 16.

Figures 1, 17:
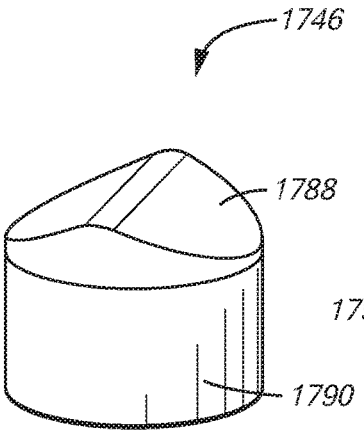
Figures 2, 17:
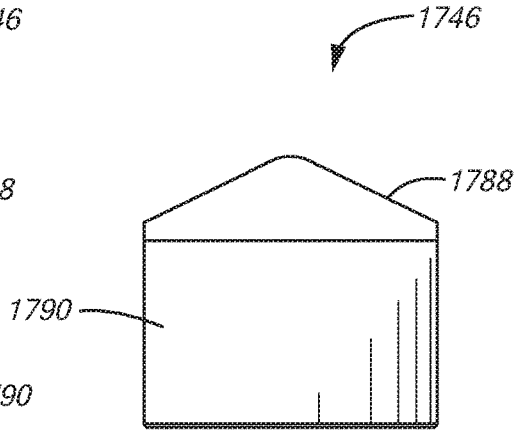
Figure 18:
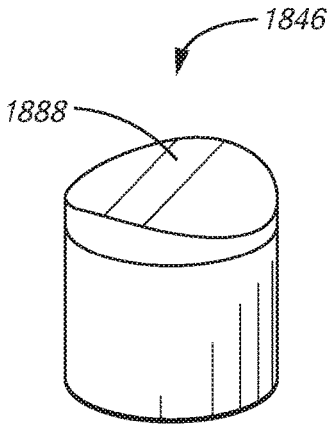

The term "ridge cutting element" refers to a cutting element that is generally cylindrical having a cutting crest (e.g., a ridge or apex) extending a height above a base or substrate (e.g., substrate 1490 of FIG. 14), and at least one recessed region extending laterally away from the crest. An embodiment of a ridge cutting element 1746 is depicted in FIGS. 17-1 and 17-2, where the cutting element top surface 1788 has a parabolic cylinder shape and is integral with, or otherwise coupled to, a substrate 1790. Variations of the ridge cutting element may also be used, and for example, while the recessed region(s) may be shown as being substantially planar, the recessed region(s) may also be convex or concave. While the crest is shown as extending substantially linearly along its length, it may also be convex or concave and may include one or more peaks and/or valleys, including one or more recessed or convex regions (e.g., depressions in the ridge). In some embodiments, the ridge cutting element may have a top surface that has a reduced height between two cutting edge portions, thereby forming a substantially saddle shape or hyperbolic paraboloid (e.g., top surface 1888 of the cutting element 1846 of FIG. 18).

It should be understood that while elements are described herein in relation to depicted embodiments, each element may be combined with other elements of other embodiments. For example, any or each of the first or second types of cutting elements of FIGS. 5-1 to 9 may be replaced by planar cutting elements, non-planar cutting elements, chip-breaking cutting elements, or other cutting elements as described herein. Further, a follow mill may have a configuration similar to a dress mill as described herein, and vice versa.

Figure 19:
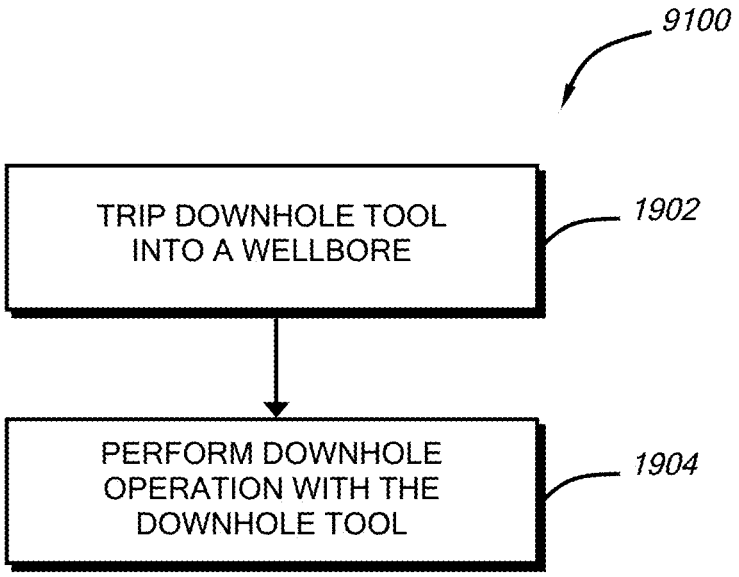
FIG. 19 is a flow chart of an example method for milling a window in a wellbore, in accordance with one or more embodiments of the present disclosure.

FIG. 19 illustrates an example embodiment of a method 1900 in a downhole environment in which a window is milled in a casing. As discussed herein, other embodiments are, however, contemplated which are outside of a downhole or oilfield environment. In FIG. 19, the method 1900 may include tripping a downhole tool into a wellbore at 1902. The downhole tool may include any number of components, assemblies, or the like, as discussed herein. In some embodiments, the downhole tool may include a milling tool (e.g., a lead mill, a follow mill, a dress mill, etc.) and a drive mechanism coupled to the bit. The drive mechanism may include a drill string rotated from a surface of the wellbore, a drill string or drive shaft rotated by a downhole component such as a downhole motor, or another drive mechanism used to rotate or otherwise move the bit. The milling tool, and components thereof, may include any number of configurations.

When the downhole tool is in the wellbore, a downhole operation may be performed with the downhole tool at 1904. The downhole operation may include, for instance, using a milling tool to form a window in a casing. The downhole operation may also include initiating a lateral borehole. For instance, a lead mill may start formation of a window in a casing and may initiate the lateral borehole. The lead mill may be deflected by a whipstock to form the window. As the window is formed, the lead mill may move down the whipstock and out the casing. Other milling tools, such as a follow mill and dress mill, may then move along the whipstock and out the window. In some embodiments, the dress mill and follow mill may perform part of the downhole operation by, for instance, expanding the casing window or cleaning-up the edges of the casing window. In at least some embodiments, the downhole operation may be facilitated by using different types of cutting structures on a follow mill, a dress mill, or both. For instance, a dress mill may include shear cutting elements in a shoulder/tapered region, and chip-breaking cutting elements in a gage region. These elements may be used in combination to form, expand, or clean-up a casing window.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation or illustrated position relative to one or more other components. Relational terms do not indicate a particular orientation for each embodiment within the scope of the description or claims. For example, a component of a bottomhole assembly that is described as "below" another component may be further from the surface while within a vertical wellbore, but may have a different orientation during assembly, when removed from the wellbore, or in a deviated or other lateral borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed should be interpreted to include components of unitary construction made from the same piece of material, or sets of materials, such as by being commonly molded or cast from the same material, or machined from the same one or more pieces of material stock. Components that are "integral" should also be understood to be "coupled."

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in any combination. Features and aspects of methods described herein may be performed in any order.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, milling systems, and other components of the present disclosure, or which would be appreciated in view of the disclosure herein, may be used in other applications and environments. In other embodiments, milling tools, drilling tools, catch mechanisms, retrieval or recovery systems, methods of milling, methods of drilling, methods of retrieving a tool, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide a lower limit, an upper limit, or both lower and upper limits. Any of the numerical values may be provided as a range using a single value (e.g., up to 50% or at least 50%) or as a range using two values (e.g., between 40% and 60%). Any single, particular value within the range is also contemplated. Numbers, percentages, ratios, measurements, or other values stated herein are intended to include the stated value as well as other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 10%, within 5%, within 1%, within 0.1%, or within 0.01% of a stated value.

The abstract included with this disclosure is provided to allow the reader to quickly ascertain the general nature of some embodiments of the present disclosure. The Abstract is submitted with the understanding that it will not be used to interpret or limit the scope or meaning of the claims.

What is claimed is:

1. A downhole milling tool, comprising:

a drill string;

a lead mill at a downhole end portion of the drill string; and a second mill coupled to the drill string, the second mill being at least one of a dress mill or follow mill, the second mill including:

a plurality of blades including a first blade and a second blade;

a gage region of at least one blade of the plurality of blades having a first type of cutting element insert; and a shoulder region of the at least one blade of the plurality of blades having a second type of cutting element insert, wherein the second type of cutting element insert is different than the first type of cutting element insert wherein the first blade comprises a first configuration of at least one of the first type or the second type of cutting element inserts, the second blade comprises a second configuration of at least one of the first or the second types of cutting element inserts, and the first configuration is different than the second configuration.

2. The downhole milling tool of claim 1, the first type of cutting element insert including a chip-breaking insert.

3. The downhole milling tool of claim 1, the second type of cutting element insert including a shear cutting insert.

4. The downhole milling tool of claim 1, the second type of cutting element insert including a non-planar cutting insert.

5. The downhole milling tool of claim 1, the second mill including a plurality of fluid recesses between the plurality of blades.

6. The downhole milling tool of claim 1, wherein first axial positions of the second type of cutting element inserts in the first configuration of the first blade are different than second axial positions of the second type of cutting element inserts in the second configuration of the second blade.

7. The downhole milling tool of claim 1, wherein first rotational orientations of the first type of cutting element inserts in the first configuration of the first blade are different than second rotational orientations of the first type of cutting element inserts in the second configuration of the second blade.

8. The downhole milling tool of claim 1, the gage region of at least one blade of the second mill having the first type of cutting element inserts at different rotational orientations.

9. The downhole milling tool of claim 1, the second mill further including a plurality of gage protection elements trailing the first type of cutting element inserts in the gage region.

10. The downhole milling tool of claim 1, the second mill being a dress mill, the downhole milling tool further comprising:

a follow mill coupled to the drill string between the lead mill and the dress mill, the follow mill including a plurality of blades with the first type of cutting element insert therein.

11. A follow mill, comprising:

a body integrally formed with a tubular on each opposing end of the body;

a plurality of blades extending axially along, and radially from, the body, the plurality of blades defining a gage region and a tapered shoulder region, and the plurality of blades including a first blade and a second blade;

a first plurality of cutting inserts in the gage region of the plurality of blades, the first plurality of cutting inserts being chip-breaking inserts, wherein the first blade comprises a same type of chip-breaking insert as the second blade, the chip-breaking insert of the first blade is in a first orientation, the chip-breaking insert of the second blade is in a second orientation, and the first orientation is different than the second orientation; and a second plurality of cutting inserts in the tapered shoulder region of the plurality of blades, the second plurality of cutting inserts being different than the first plurality of cutting inserts in the gage region and not being in the gage region.

12. The follow mill of claim 11, the plurality of blades defining a plurality of pockets in the tapered shoulder region, each of the plurality of pockets including a single one of the second plurality of cutting inserts.

13. The follow mill of claim 11, the plurality of blades defining a plurality of recesses in the gage shoulder region, each of the plurality of recesses including multiple cutting inserts of the first plurality of cutting inserts.

14. The follow mill of claim 11, the first blade having a chip-breaking insert with a chip-breaking feature extending along a length of the blade.

15. The follow mill of claim 11, the second blade having a chip-breaking insert with a chip-breaking feature extending along a height of the blade.

16. A method for milling a window in casing, comprising:

tripping a downhole tool into a wellbore, the downhole tool including at least a lead mill and a dress mill or a follow mill;

forming a window in casing around the wellbore using the lead mill; and moving the lead mill through the window, and expanding the window or cleaning casing around the window with the dress or follow mill, wherein expanding the window or cleaning casing around the window includes:

using a shear cutting element insert in a shoulder region of the dress or follow mill; and using a chip-breaking cutting element insert in a gage region of the dress or follow mill.

17. The method of claim 16, further comprising:

protecting the gage of the gage region using one or more gage protection inserts in the gage region, the gage protection inserts rotationally trailing the chip-breaking cutting element inserts.

18. The method of claim 16, further comprising:

diverting the lead mill and the follow or dress mill from a primary wellbore by using a whipstock.

* * * * *